US009252006B2

(12) United States Patent
Matsumoto

(10) Patent No.: US 9,252,006 B2
(45) **Date of Patent: *Feb. 2, 2016**

(54) INCANDESCENT BULB, FILAMENT, AND METHOD FOR MANUFACTURING FILAMENT

(71) Applicant: STANLEY ELECTRIC CO., LTD., Meguro-ku, Tokyo (JP)

(72) Inventor: Takahiro Matsumoto, Yokohama (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/354,557

(22) PCT Filed: Oct. 24, 2012

(86) PCT No.: PCT/JP2012/077444

§ 371 (c)(1),
(2) Date: Apr. 25, 2014

(87) PCT Pub. No.: WO2013/061993

PCT Pub. Date: May 2, 2013

(65) Prior Publication Data

US 2014/0292188 A1 Oct. 2, 2014

(30) Foreign Application Priority Data

Oct. 27, 2011 (JP) ..... 2011-236271

(51) Int. Cl.
*H01K 1/50* (2006.01)
*H01K 1/02* (2006.01)
(Continued)

(52) U.S. Cl.
CPC .. *H01K 1/02* (2013.01); *H01K 1/40* (2013.01); *H01K 3/02* (2013.01)

(58) Field of Classification Search
CPC ..... H01K 1/02; H01K 1/40; H01K 3/02; H01K 1/00–1/10; H01K 1/14; H01K 1/18; H01K 1/28
USPC ..... 313/567–643, 9, 341
See application file for complete search history.

(56) References Cited

U.S. PATENT DOCUMENTS 1,854,970 A 4/1932 Agte
1,889,598 A 11/1932 Force
(Continued)

FOREIGN PATENT DOCUMENTS

GB 1074203 A 6/1967
GB 2032173 A 4/1980
(Continued)

OTHER PUBLICATIONS

F. Kusunoki, et al., "Narrow-Band Thermal Radiation with Low Directivity by Resonant Modes inside Tungsten Microcavities", Japanese Journal of Applied Physics, vol. 43, No. 8A, 2004, pp. 5253-5258 (in English).
(Continued)

*Primary Examiner* — Anne Hines
*Assistant Examiner* — Jose M Diaz
(74) *Attorney, Agent, or Firm* — Holtz, Holtz & Volek PC

(57) ABSTRACT

An object of the present invention is to provide a filament showing improved conversion efficiency with a simple configuration. According to the present invention, surface of a filament material processed into a predetermined shape is processed into a mirror surface by mechanical polishing, and surface roughness (center line average roughness Ra) thereof is thereby made to be 1 μm or smaller. Reflectance of the filament can be thereby improved, and emissivity of the filament for lights of the infrared wavelength region can be suppressed.

4 Claims, 7 Drawing Sheets

(51) Int. Cl.
*H01K 3/02* (2006.01)
*H01K 1/40* (2006.01)

(56) References Cited

U.S. PATENT DOCUMENTS

| | | | | |
|---|---|---|---|---|
| 1,925,857 | A | 9/1933 | Liempt | |
| 3,022,439 | A | 2/1962 | Cooper et al. | |
| 4,196,368 | A | 4/1980 | Hauer | |
| 5,079,473 | A | 1/1992 | Waymouth | |
| 5,896,007 | A | 4/1999 | Dobiasch et al. | |
| 2002/0125806 | A1 | 9/2002 | Sugimura et al. | |
| 2006/0132014 | A1 | 6/2006 | Horiuchi et al. | |
| 2009/0045742 | A1 | 2/2009 | Bunk et al. | |
| 2010/0327731 | A1 | 12/2010 | Aurongzeb et al. | |
| 2014/0084785 | A1* | 3/2014 | Matsumoto et al. | 313/569 |
| 2014/0361675 | A1* | 12/2014 | Matsumoto | 313/112 |

FOREIGN PATENT DOCUMENTS

| | | | |
|---|---|---|---|
| JP | 55-41663 | A | 3/1980 |
| JP | 55-72357 | A | 5/1980 |
| JP | 60-147154 | U | 9/1985 |
| JP | 03-102701 | A | 4/1991 |
| JP | 04-349338 | A | 12/1992 |
| JP | 06087656 | A | 3/1994 |
| JP | 08064110 | A | 3/1996 |
| JP | 2002-334649 | A | 11/2002 |
| JP | 2004-158319 | A | 6/2004 |
| JP | 2005068002 | A | 3/2005 |
| WO | WO 2005/052987 | A1 | 6/2005 |

OTHER PUBLICATIONS

International Search Report (ISR) dated Nov. 27, 2012 (and English translation thereof) issued in International Application No. PCT/JP2012/077444.

International Preliminary Report on Patentability (IPRP) dated May 8, 2014 issued in International Application No. PCT/JP2012/077444.

Related U.S. Appl. No. 14/033,334; First Named Inventor: Takahiro Matsumoto; Title: "Light Source Device, Method for Manufacturing the Same and Filament"; filed Sep. 20, 2013.

* cited by examiner

W rough surface

W mirror surface

Mo rough surface

Mo mirror surface

Ta rough surface

Ta mirror surface

INCANDESCENT BULB, FILAMENT, AND METHOD FOR MANUFACTURING FILAMENT

TECHNICAL FIELD

The present invention relates to an incandescent light bulb showing improved energy utilization efficiency, in particular, an incandescent light bulb and thermoelectronic emission source using such a filament.

BACKGROUND ART

There are widely used incandescent light bulbs which produce light with a filament such as tungsten filament heated by flowing an electric current through it. Incandescent light bulbs have various advantages, for example, (a) they are inexpensive, (b) they show superior color rendering properties, (c) they can be used with any operating voltage (they can work with either alternating current or direct current), (d) they can be lightened with a simple lighting implement, (e) they are used worldwide, and so forth. However, efficiency of incandescent light bulbs for conversion from electric power to visible light is about 15 lm/W, which is lower than that of fluorescent lamps (conversion efficiency is 90 lm/W), and therefore they impose larger environmental loads.

Patent document 1 discloses that multiple microcavities (holes) are formed on the surface of filament to prevent radiation of lights having a wavelength of 700 nm or longer and control luminous intensity distribution, in order to enhance the conversion efficiency into visible light.

Further, Non-patent document 1 discloses a microstructure formed on the surface of filament, and the physical effects of the microstructure, i.e., radiation-enhancing and radiation-suppressing effects for a part of infrared lights.

PRIOR ART REFERENCES

Patent document

Patent document 1:. Japanese Patent Unexamined Publication (KOKAI) No. 2004-158319

Non-Patent Document

Non-patent document 1: F. Kusunoki et al., Jpn. J. Appl. Phys., 43, 8A, 5253 (2004).

SUMMARY OF THE INVENTION

Object to be Achieved by the Invention

With the techniques of forming a microstructure in the filament disclosed in Patent document 1 and Non-patent document 1, radiation of a part of infrared lights can be suppressed. However, if radiation of light of a certain wavelength is suppressed, radiation of light of another wavelength will be enhanced, and therefore it is difficult to suppress radiation of infrared lights of the wide whole infrared wavelength region. Accordingly, it is considered that it. is difficult to significantly improve the conversion efficiency of incandescent light bulbs by using these techniques. Moreover, in order to form a microstructure on the surface of filament, it is necessary to use the electron beam exposure technique or the like, and it raises the production cost. For this reason, use of the techniques results in expensive filaments, and therefore it is not easy to use them for generally used inexpensive incandescent light bulbs.

An object of the present invention is to provide a filament showing improved conversion efficiency with a simple configuration.

Means for Achieving the Object

In order to achieve the aforementioned object, the incandescent light bulb provided by the present invention comprises a translucent gastight container, a filament disposed in the translucent gastight container, and a lead wire for supplying an electric current to the filament, and surface of the filament is polished into a mirror surface.

Effect of the Invention

According to the present invention, the reflectance of the surface of the filament for lights of the infrared wavelength region can be improved to suppress radiation of lights of the infrared wavelength region of the filament with the simple configuration, i.e., the mirror-polished surface of the filament. The efficiency for converting input power into visible lights can be thereby increased.

MODES FOR CARRYING OUT THE INVENTION

According to the present invention, the surface of the filament is polished into a mirror surface having a surface roughness (center line average roughness Ra) of 1 μm or smaller. The reflectance of the filament can be thereby made to be 0.9 or larger for lights of the infrared wavelength region of a wavelength of 3 μm or longer, and the radiation rate (emissivity) thereof for lights of the infrared wavelength region can be thereby suppressed.

A specific example of the present invention will be explained with reference to the drawings.

Figure 1:
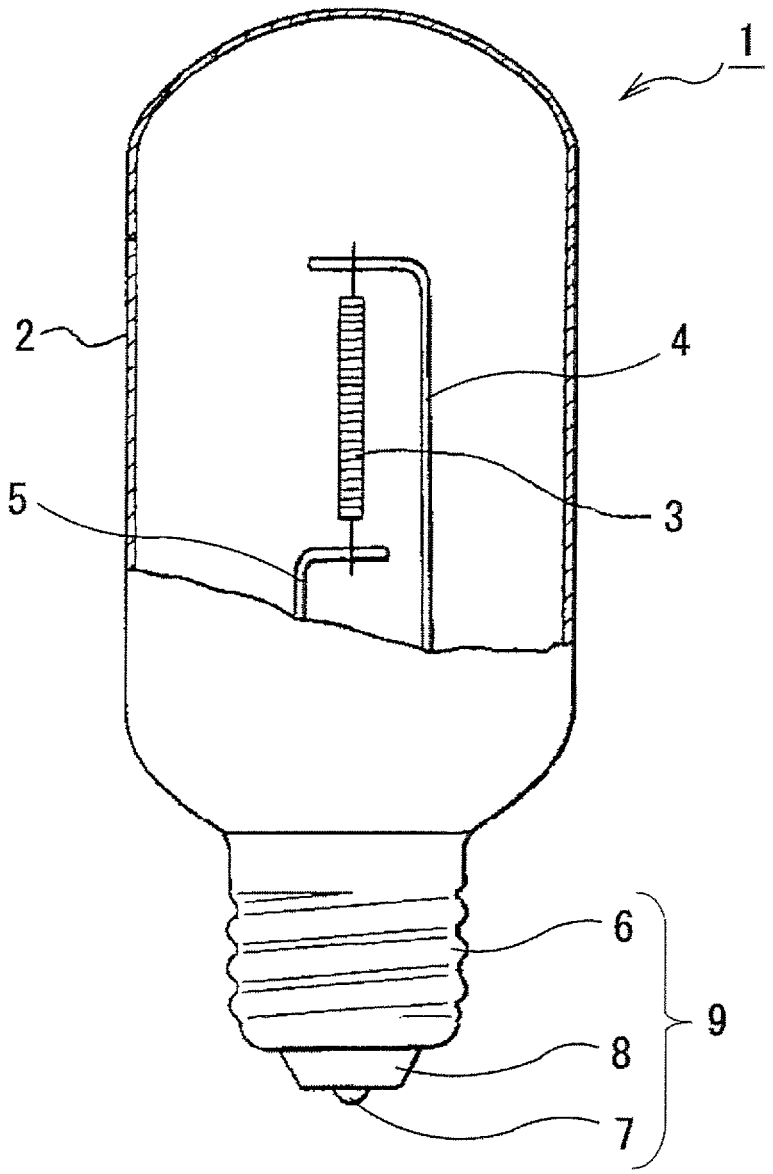
FIG. 1 shows a broken sectional view of an exemplary incandescent light bulb.

FIG. 1 shows a broken sectional view of the incandescent light bulb of the example. The incandescent light bulb 1 is constituted with a translucent gastight container 2, a filament 3 disposed in the inside of the translucent gastight container 2, and a pair of lead wires 4 and 5 electrically connected to the both ends of the filament 3 and supporting the filament 3. The translucent gastight container 2 is constituted with, for example, a glass bulb. The inside of the translucent gastight container 2 is maintained to be a high vacuum state of $10^{-3}$ to $10^{-6}$ Pa or an inert gas atmosphere such as argon with the pressure of the order of $10^{0}$ to $10^{6}$ Pa.

A base 9 is adhered to a sealing part of the translucent gastight container 2. The base 9 comprises a side electrode 6, a center electrode 7, and an insulating part 8, which insulates the side electrode 6 and the center electrode 7. One end of the lead wire 4 is electrically connected to the side electrode 6, and one end of the lead wire 5 is electrically connected to the center electrode 7.

The filament 3 consists of a wire-shaped material of a metal or alloy showing high melting point wound into a spiral structure. As the wire-shaped material, there can be used, for example, tungsten, molybdenum, constantan, tantalum, rhenium, niobium, iridium, osmium, chromium, zirconium, platinum, vanadium, ruthenium, rhodium, iron, stainless steel, and alloys containing one or more of the foregoing materials.

The wire-shaped material is usually produced such a process as sintering or drawing of a material metal. Since a wire-shaped material produced by sintering, drawing or the like has a rough surface, it shows low reflectance. According to the present invention, the surface of the wire-shaped material is polished to increase the reflectance for lights of the infrared wavelength region and larger wavelengths and thereby suppress the emissivity of lights of the infrared wavelength region and larger wavelengths.

Hereafter, the present invention will be specifically explained by exemplifying a tungsten filament, which is most frequently used.

The raw material of a tungsten filament is generally wolframite or scheelite. Wolframite is treated with an alkali, scheelite is treated with hydrochloric acid, and each resultant is refined by the wet method to produce crystals of ammonium para-tungstate. This product is thermally decomposed in the air or a hydrogen atmosphere to produce tungstic oxide. Then, tungstic oxide is reduced at 800 to 1200 K in a hydrogen flow to obtain metal tungsten powder. The metal tungsten powder is press-molded at 50 to 500 MPa, pre-sintered at 1300 to 1500 K in a hydrogen flow, and then sintered at about 3000 to 3300 K by electric resistance heating. The obtained sintered compact is subjected to swaging and drawing to produce a wire-shaped material (line ingot). A filament of a shape other than the line ingot is produced by forging or rolling from the sintered compact or line ingot as a raw material. Then, the surface of the filament is polished by electric field polishing.

Recrystallized grains of pure tungsten have the equiaxial crystal structure, a comparatively round shape, and a lot of grain boundaries perpendicular to the line axis. Therefore, a filament coil made of a pure tungsten wire is deformed (creep deformation) even with a small external force such as own weight when it is used at high temperature due to slip at the crystal grain boundaries extending in the radial direction of the filament. The deformed filament causes local overheating and easily breaks. In order to prevent such a phenomenon, it is desirable to use doped tungsten as a filament to be operated at a high temperature. By adding a small amount of thorium oxide or potassium to tungsten, grain growth along the radial direction of the filament is suppressed, and the recrystallized grains become huge crystals extending long along the processing direction (axial direction). Therefore, strength of the doped tungsten at high temperature can be improved compared with a pure tungsten wire. Specifically, thorium oxide ($ThO_2$) finely disperses at the tungsten crystal grain boundaries and is stable at high temperature, and therefore it has actions of preventing movement of the grain boundaries and suppressing the growth of crystalline grains to produce small recrystallized grains. Potassium is extended and divided along the axial direction of the wire at the time of swaging and drawing, and it forms sequences of microbubbles at high temperature to show an action of suppressing the growth of crystal grains along the radial direction to form huge recrystallized grains extending along the axial direction, i.e., the processing direction. The secondary recrystallization temperature of the tungsten doped with thoria or potassium is thereby made to be as high as 2000 K or higher.

When tungsten is used for a filament, doped tungsten or pure tungsten can be chosen according to the functions desired for the filament and so forth and used, so that the advantages characteristic to each material are fully exploited.

Figure 2:
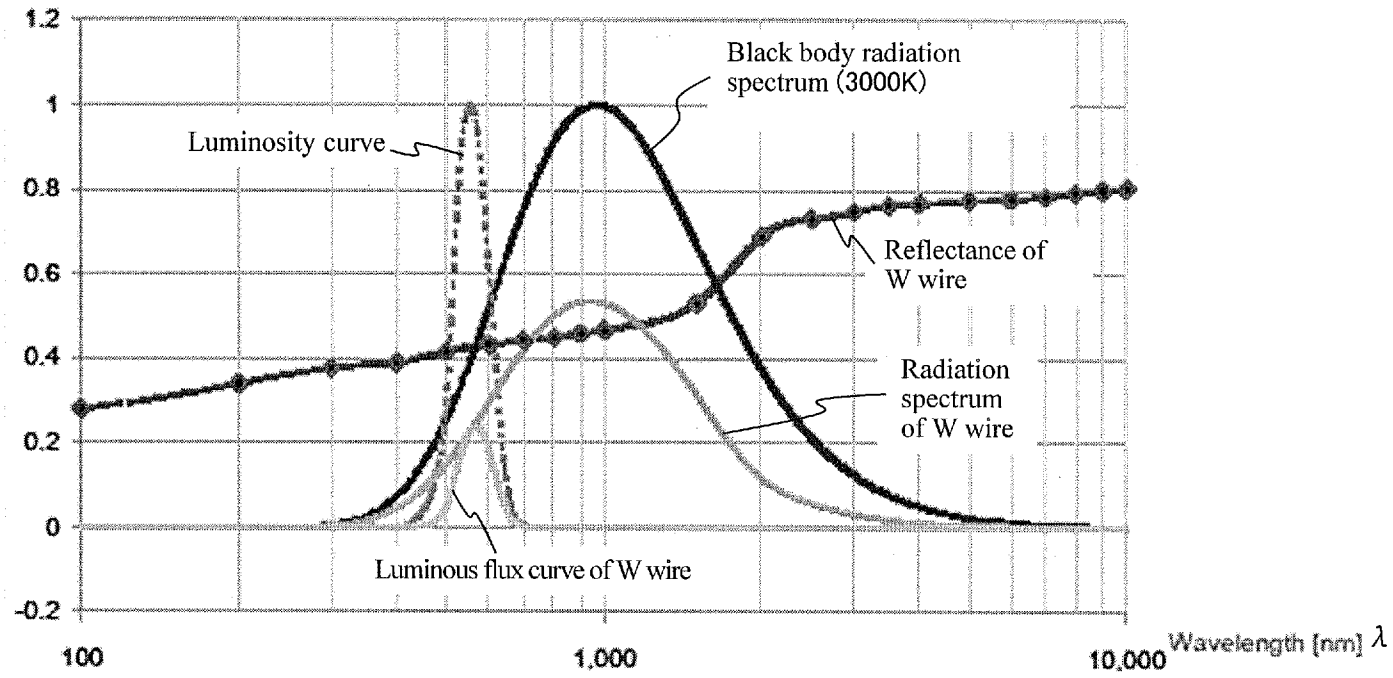
FIG. 2 is a graph showing a reflectance curve and a radiation spectrum of an exemplary tungsten filament before polishing.

A tungsten filament produced by the aforementioned , manufacturing process has a large surface roughness. For example, a tungsten filament produced by the aforementioned manufacturing process has a center, line average roughness Ra larger than 1 μm, and shows such a reflectance ($\gamma(\lambda)$) as shown in FIG. 2 ($\lambda$ is wavelength). The emissivity $\epsilon(\lambda)$ can be calculated in accordance with the equation $\epsilon(\lambda)=1-\gamma(\lambda)$ according to the Kirchhoff's law. FIG. 2 also shows the radiation spectrum, black body radiation spectrum (3000 K), luminosity curve, and luminous flux curve (the convolution of luminosity curve and radiation spectrum), for tungsten. The radiation spectrum of tungsten is obtained by multiplying the emissivity $\epsilon(\lambda)$ and the black body radiation spectrum of tungsten. The luminous flux curve of tungsten is obtained by multiplying the luminosity curve and the radiation spectrum of tungsten.

Energy P (radiation) dissipated by the radiation of light from the tungsten filament to the outer space can be calculated in accordance with the following equation (1).

[Equation 1]

$$P(\text{Radiation}) = \int_0^{\infty} \varepsilon(\lambda) \frac{\alpha\lambda^{-5}}{\exp(\beta/\lambda T)^{-1}} d\lambda \tag{1}$$

In the equation (1), $\epsilon(\lambda)$ is emissivity at each wavelength as described above, $\alpha\lambda^{-5}/(\exp(\beta/\lambda T)-1)$ represents the Planck's law of radiation, $\alpha=3.747\times10^{8}$ W $\mu m^4/m^2$, and $\beta=1.4387\times10^{4}$ μmK.

If the ratio of radiation energies of the filament for the total wavelength region and the visible region calculated in accordance with the equation (1) is defined as the visible light conversion efficiency, the visible light conversion efficiency (radiation efficiency) of a usual tungsten filament having a coarse surface is about 27 lm/W at a temperature of about 3000 K. The actually measured conversion efficiency of an incandescent light bulb from electric power to visible lights is further lower than this value by about 30%, i.e., about 15 to 20 lm/W. It is considered that this loss is heat conduction loss in the lead wires 4 and 5, and the base 9 for supplying electric current to the filament 3 of the incandescent light bulb.

According to the present invention, the surface of the filament is made into a mirror surface by mechanical polishing to increase the reflectance thereof for lights of the wavelengths of the infrared wavelength region and larger wavelengths. The emissivity for lights of the wavelengths of the infrared wavelength region and larger wavelengths is thereby suppressed to convert much of the input energy into visible light components.

For example, it is desirable to polish the surface of a tungsten filament so that the reflectance of the tungsten filament for lights of the infrared wavelength region of a wavelength of 3 μm or longer becomes 0.9 or larger, and the reflectance of the same for the visible light wavelength region of a wavelength of 0.7 μm or shorter becomes 0.6 or smaller. For this purpose, the center line average roughness Ra of the surface is preferably 1 μm or smaller, particularly preferably 0.5 μm or smaller. The center line average roughness Ra referred to here is measured with a contact surface roughness meter. Further, the surface oxide film is removed from the surface of the filament by the polishing. Therefore, the reflectance of the filament is further improved by the absence of the surface oxide film, in addition to the smooth surface without unevenness.

The relationship of the center line average roughness Ra and the reflectance $\gamma(\lambda)$ can be qualitatively described as the following equation (2) for the region of roughness where Ra is 5 μm or smaller.

$$\gamma(\lambda)=1-\alpha(\lambda)Ra \quad (2)$$

In the equation, $\alpha(\lambda)$ is a shape factor correlating with the center line average roughness Ra determined according to wavelength and type of material and the reflectance $\gamma(\lambda)$. Concerning the metal material used for the present invention, it dose not greatly depend on the material, and it has a value of about 0.1 to 0.2 ($\mu m^{-1}$) for a wavelength of 3 μm.

Figure 3:
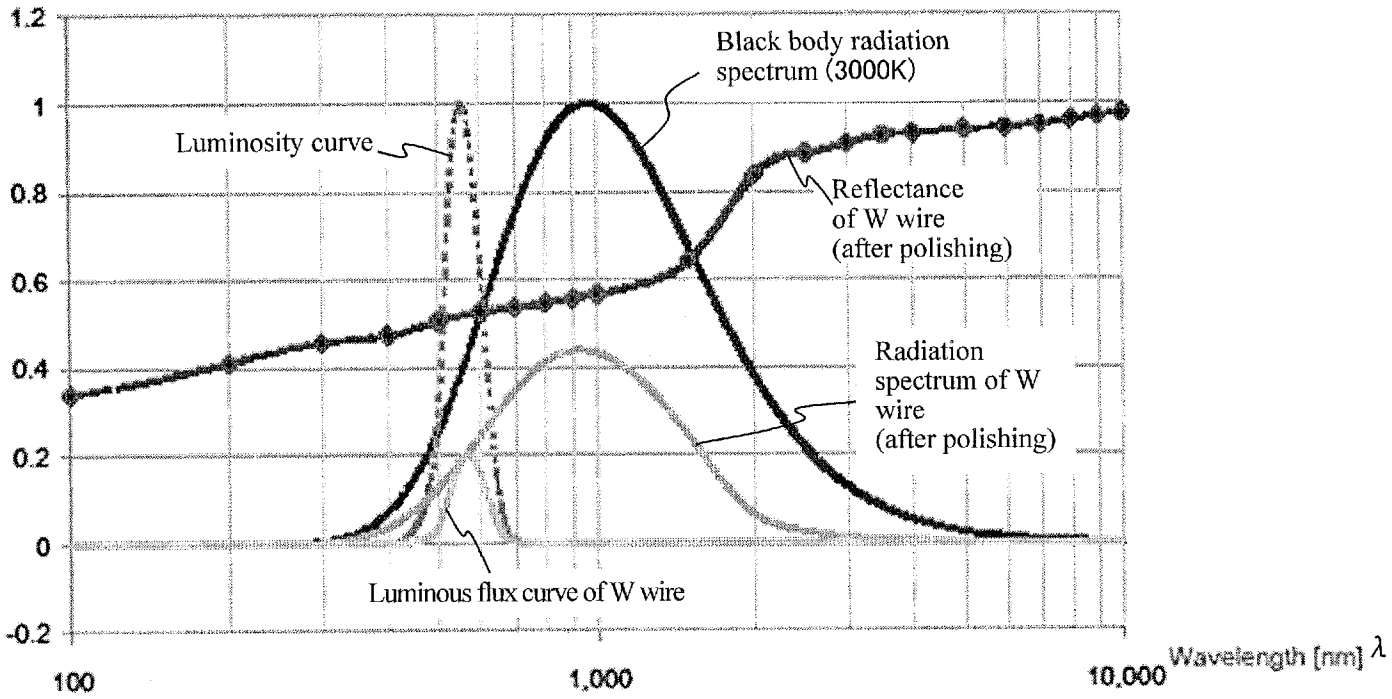
FIG. 3 is a graph showing a reflectance curve and a radiation spectrum of the exemplary tungsten filament after polishing.

Specifically, by polishing a tungsten filament produced by the aforementioned manufacturing process with two or more kinds of diamond polishing grains so that the filament has a mirror surface showing a center line average roughness Ra of 0.2 μm or smaller, the maximum value of the reflectance can be improved to be about 0.98, as shown in FIG. 3. The emissivity for lights of the infrared region of a wavelength of 3 μm or longer can be thereby suppressed compared with the filament not subjected to the mechanical polishing. The radiation spectrum of the tungsten filament subjected to the mechanical polishing is as shown in FIG. 3. The visible light conversion efficiency of the tungsten filament calculated by using the emissivity obtained after the mechanical polishing is 31.3 lm/W, and thus the visible light conversion efficiency can be made to be about 1.2 times of that of the tungsten filament not subjected to the mechanical polishing, 27 lm/W.

Figure 4:
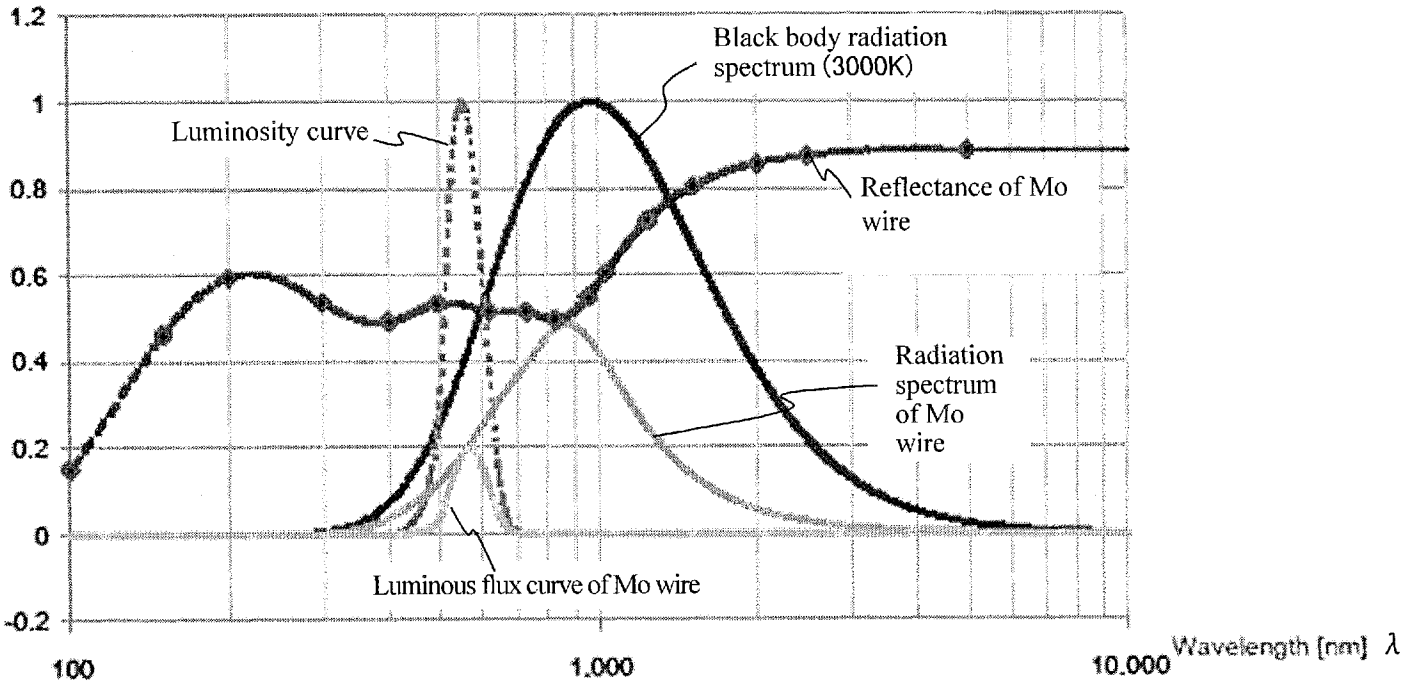
FIG. 4 is a graph showing a reflectance curve and a radiation spectrum of an exemplary molybdenum filament before polishing.
Figure 5:
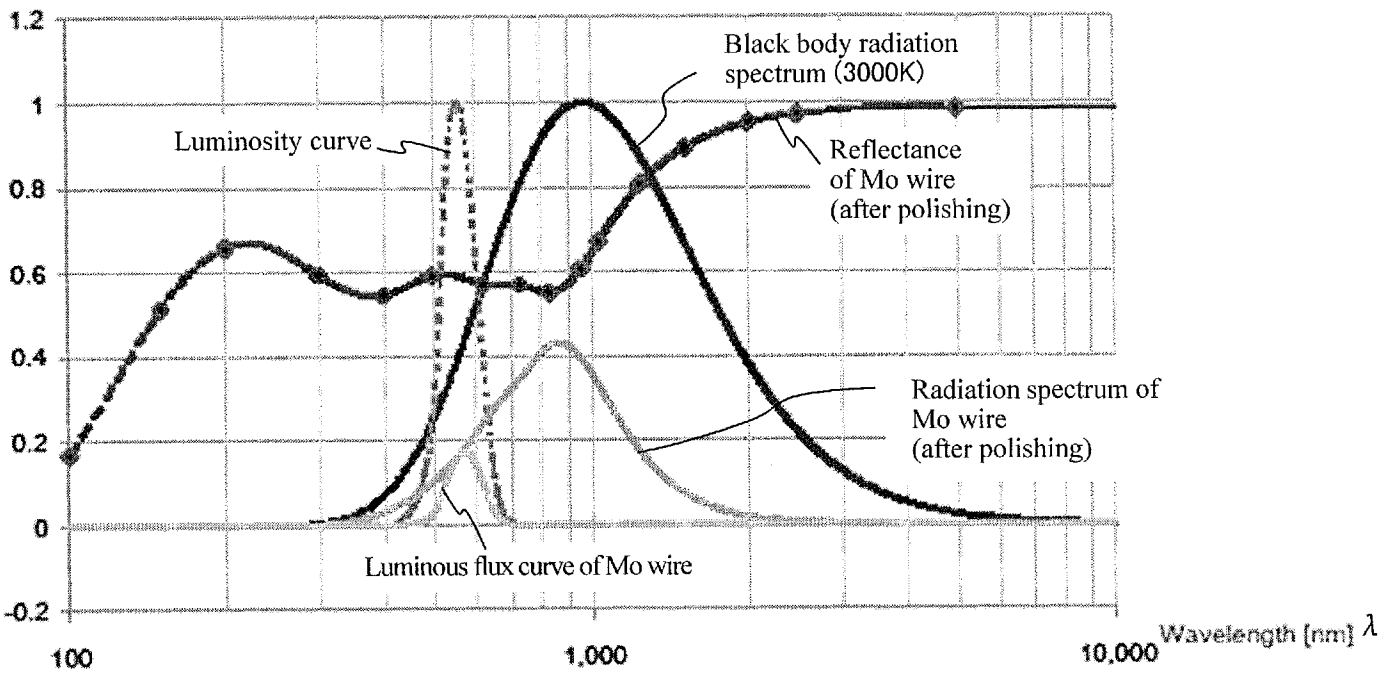
FIG. 5 is a graph showing a reflectance curve and a radiation spectrum of the exemplary molybdenum filament after polishing.

In the aforementioned explanation, the tungsten filament was explained as an example. However, visible light conversion efficiency of a filament of not only tungsten, but also another material, can be similarly improved by performing the mirror surface processing. For example, in the case of a molybdenum wire, a molybdenum wire not subjected to the polishing and showing a center line average roughness Ra larger than 1 μm shows such a reflectance curve as shown in FIG. 4, and shows a visible light conversion efficiency of 35.3 lm/W. However, when the center line average roughness Ra thereof is made to be 0.1 μm or smaller by the polishing, the reflectance increases by about 10% as shown in FIG. 5. As a result, the visible light conversion efficiency becomes 43.4 lm/W, and thus it can be improved by 20% or more compared with that observed before the polishing.

Figure 6:
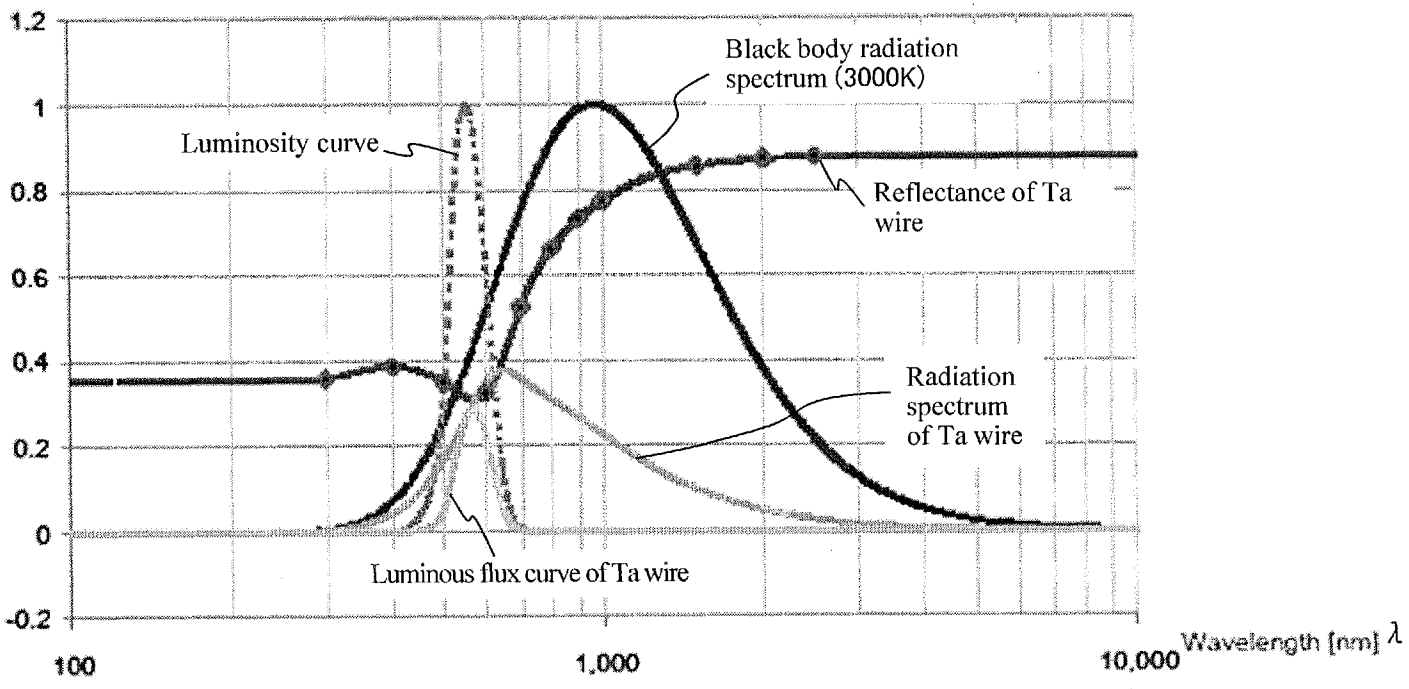
FIG. 6 is a graph showing a reflectance curve and a radiation spectrum of an exemplary tantalum filament before polishing.
Figure 7:
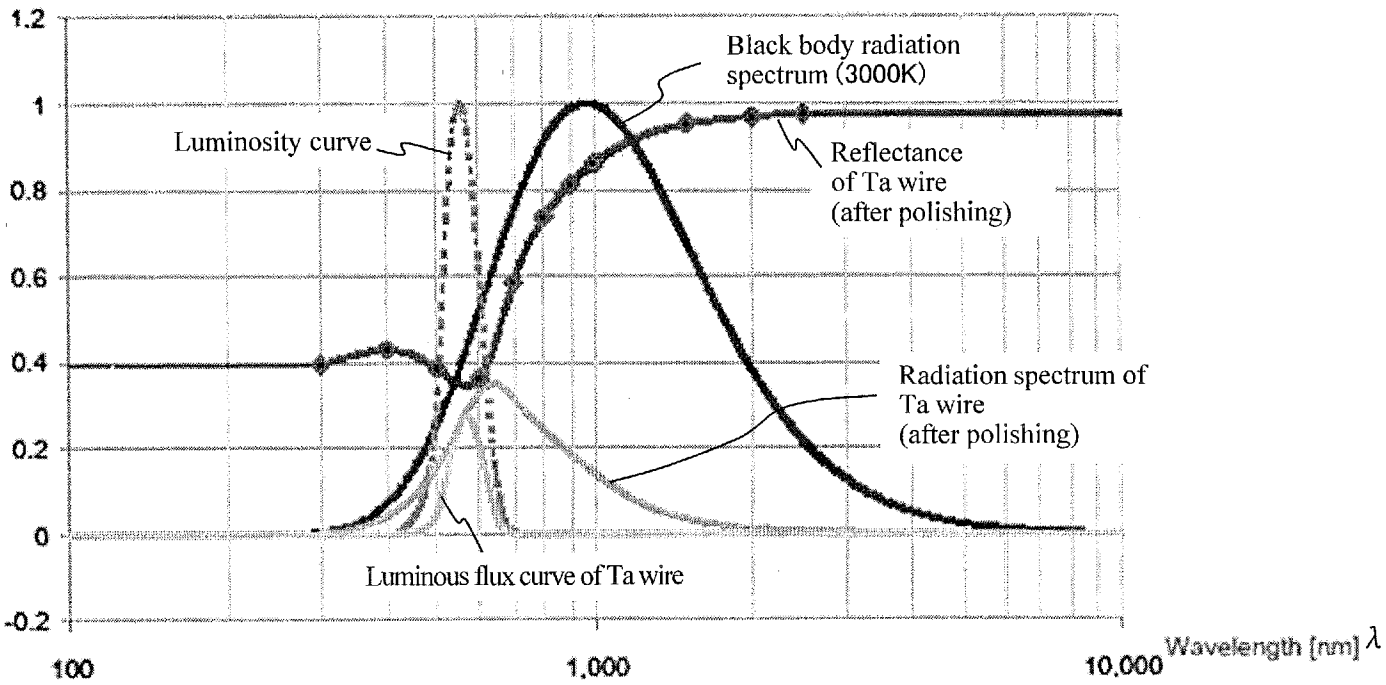
FIG. 7 is a graph showing a reflectance curve and a radiation spectrum of the exemplary tantalum filament after polishing.

Further, in the case of a tantalum wire, a tantalum wire not subjected to the polishing and showing a center line average roughness Ra larger than 1 μm shows such a reflectance curve as shown in FIG. 6, and shows a visible light conversion efficiency of 63.7 lm/W. However, when the center line average roughness Ra thereof is made to be 0.1 μm or smaller by the polishing, the reflectance increases by about 10% as shown in FIG. 7. As a result, the visible light conversion efficiency becomes 100.4 lm/W, and thus it can be improved by 60% or more compared with that observed before the polishing.

Also in the cases of a molybdenum wire and a tantalum wire, they are desirably polished so that the reflectance thereof for lights of infrared wavelengths ($\lambda$=3 μm or larger) exceeds 0.9, as in the case of tungsten. For this requirement, the center line average roughness Ra is preferably 1 μm or smaller, particularly preferably 0.1 μm or smaller. The center line average roughness Ra referred to here is measured with a contact surface roughness meter.

The improvement rate of the visible light conversion efficiency provided by improving the reflectance by the polishing of a filament as described above is larger in the order of tantalum, molybdenum, and tungsten, and this tendency is provided by the positional (wavelength) relationship of the peak in the radiation spectrum and the position of the inflexion point of the reflectance curve. For example, in the case of the tungsten wire, the position from which the reflectance significantly reduces as the wavelength becomes shorter (point of inflexion) is present around 1.5 μm, but the peak of the radiation spectrum is present at 1 μm as shown in FIGS. 2 and 3. Therefore, significant infrared light radiation suppression effect cannot be obtained by improvement in the reflectance. On the other hand, in the case of the tantalum wire, the position from which the reflectance significantly reduces as the wavelength becomes shorter (point of inflexion) is present around a wavelength of 0.7 to 0.8 μm, and the peak of the radiation spectrum is also present around 0.7 to 0.8 μm. Therefore, significant infrared light radiation suppression effect can be obtained by the improvement in the reflectance.

As described above, according to the present invention, radiation of lights of the infrared region can be suppressed with the simple configuration, i.e., improvement in the reflectance of the surface of the filament, and as a result, the visible light conversion efficiency based on input power can be enhanced. An inexpensive and efficient energy-saving illumination electric bulb can be thereby provided.

In the aforementioned example, the reflectance of the surface of the filament is improved by mechanical polishing. However, it is of course also possible to use not only the mechanical polishing, but also other methods, so long as the reflectance of the surface of the filament can be improved. For example, wet and dry etching techniques, contact with a mold having a smooth surface at the time of drawing, forging, or rolling, and so forth can be employed.

Although the aforementioned example is explained by exemplifying use of the filament of the present invention as a filament of an incandescent light bulb, it can be used for a purpose other than incandescent light bulb. For example, it can be used as an electric wire for heaters, electric wire for welding processing, electron source of thermoelectronic emission (X-ray tube, electron microscope, etc.), and so forth. Also in these cases, the filament can be efficiently heated to high temperature with low input power because of the infrared light radiation suppressing action, and therefore the energy efficiency can be improved.

DESCRIPTION OF NUMERICAL NOTATIONS

1 . . . Incandescent light bulb, 2 . . . translucent gastight container, 3 . . . filament, 4 . . . lead wire, 5 . . . lead wire, 6 . . . side electrode, 7 . . . center electrode, 8 . . . insulating part, 9 . . . base

The invention claimed is:

1. An incandescent light bulb comprising:

a translucent gastight container, a filament disposed in the translucent gastight container, and a lead wire for supplying an electric current to the filament, wherein the filament is processed so as to have a surface roughness (center line average roughness Ra) of 1 μm or smaller.

2. A filament processed to have a surface roughness (center line average roughness Ra) of 1 μm or smaller.

3. The incandescent light bulb according to claim 1, wherein reflectance of the filament for lights in an infrared wavelength region of a wavelength of 3 μm or longer is 0.9 or larger, and reflectance of the filament for lights in a visible light wavelength region of a wavelength of 0.7 μm or shorter is 0.6 or smaller.

4. A heater comprising the filament according to claim 2.

* * * * *